United States Patent [19]

Wade

[11] 4,149,916

[45] Apr. 17, 1979

[54] CAP SENSITIVE EMULSIONS CONTAINING PERCHLORATES AND OCCLUDED AIR AND METHOD

[75] Inventor: Charles G. Wade, Lehighton, Pa.

[73] Assignee: Atlas Powder Company, Tamaqua, Pa.

[21] Appl. No.: 848,334

[22] Filed: Nov. 3, 1977

[51] Int. Cl.[2] ..... C06B 31/42

[52] U.S. Cl. ..... 149/56; 149/57; 149/46; 149/60; 149/61; 149/69; 149/70; 149/76; 149/77; 149/80; 149/83; 149/85

[58] Field of Search ..... 149/56, 57, 2, 61, 46, 149/69, 76, 70, 77, 85, 80, 83, 60

[56] References Cited

U.S. PATENT DOCUMENTS 3,770,522 11/1973 Tomic ..... 149/46 X

*Primary Examiner*—Stephen J. Lechert, Jr.

*Attorney, Agent, or Firm*—Richards, Harris & Medlock

[57] ABSTRACT

Water-in-oil explosive compositions containing perchlorates and occluded air are provided which are detonable by a standard No. 8 blasting cap and which contain from about 14 to about 20 weight percent water, from about 3 to about 7 weight percent fuel, from about 56 to about 63 weight percent ammonium nitrate, from about 2 to about 12 weight percent of another inorganic nitrate, and from about 3 to about 12 weight percent of an inorganic perchlorate. The fuel material further comprises from about 0.5 to about 1.5% of a water-in-oil emulsifier, from 0 to about 1% oil, and at least 2% wax, based upon the weight of the emulsion.

42 Claims, No Drawings

CAP SENSITIVE EMULSIONS CONTAINING PERCHLORATES AND OCCLUDED AIR AND METHOD

BACKGROUND OF THE INVENTION

This invention relates to water-in-oil emulsion explosive compositions. In another aspect, this invention relates to improved water-in-oil emulsion explosive compositions that contain nitrates, perchlorates and occluded air, that are detonable by a standard No. 8 blasting cap, and that are made of non-explosive components. A further aspect of this invention relates to No. 8 cap sensitive water-in-oil emulsion explosives that contain no sensitizer other than occluded air.

Water-in-oil emulsion type blasting agents are disclosed by Bluhm in U.S. Pat. No 3,447,978. These emulsion type blasting agents contain an aqueous solution of inorganic oxidizer salt which is emulsified as the disperse phase within a continuous carbonaceous fuel phase, and a uniformly distributed gaseous component. Such emulsion type blasting agents have many advantages over water slurry type blasting agents, but they are not cap sensitive. Therefore, such materials require a booster in order to effect their detonation.

Cattermole et al, in U.S. Pat. No. Re. 28,060 teaches the addition of certain amine nitrate compounds to the water-in-oil emulsion compositions in order to assure that once detonated, the explosion will propagate in a 2 or 3 inch borehole. However, the mere addition of amine nitrates to the conventional water-in-oil emulsion type blasting agents will not render such materials cap senstive. U.S. Pat. No. 3,770,522 suggests that the addition of materials such as trinitrotoluene, pentaerythritol tetranitrate, and the like, to conventional water-in-oil blasting agents will render them cap sensitive. However, it is well known that such materials are high explosives and are more expensive than conventional ingredients that go into the water-in-oil emulsion blasting agents, and the resulting products do not adequately perform in small diameter boreholes and are undesirable from other standpoints.

U.S. Pat. Nos. 3,715,247 and 3,765,964 disclose that water-in-oil emulsion explosive compositions can be prepared which retain all the advantages of the emulsion blasting agents described above, but are cap sensitive without the use of an explosive ingredient. These latter two patents disclose the addition of a detonation sensitizer or catalyst, such as an inorganic metal compound of Atomic No. 13 or greater, and strontium compounds.

Therefore, water-in-oil emulsion explosive compositions are needed that achieve cap sensitivity without the use of sensitizers other than occluded air, yet are characterized by good low temperature detonability and extended storage life.

SUMMARY OF THE INVENTION

According to the subject invention, improved water-in-oil emulsion explosive compositions are provided that contain a continuous hydrocarbon fuel phase and a discontinuous water phase containing dissolved inorganic nitrates and perchlorate as the oxidizers and that do not contain explosive ingredients, detonation catalysts, nor any sensitizer other than occluded air, yet can be detonated with a No. 8 cap at diameters of 1.25 inches or less. The improved cap sensitive water-in-oil emulsion explosives of the subject invention contain from about 14 to about 20 weight percent water, from about 3 to about 7 weight percent fuel, from about 56 to about 63 weight percent ammonium nitrate, from about 2 to about 12 weight percent of another inorganic nitrate, and from about 3 to about 12 weight percent of an inorganic perchlorate. The fuel component will contain at least about 2 weight percent wax, from about 0.5 to about 1.5 weight percent of a water-in-oil emulsifier and from 0 to about 1 weight percent oil. The density of the explosives will range from about 0.80 to less than about 1.0 g/cc, and preferably from about 0.90 to about 0.95 g/cc, at the time of manufacture. The improved water-in-oil explosive compositions of the subject invention are characterized by good low temperature detonability and extended storage life.

DETAILED DESCRIPTION OF THE INVENTION

Thus, I have discovered that water-in-oil emulsion explosive compositions can be made and detonated with at least a No. 8 cap at diameters of 1.25 inches or less by the utilization of hydrocarbon fuels, water, inorganic nitrate and perchlorate oxidizer salts, but without any sensitizer other than occluded air. Other sensitizers utilized in compositions taught by the prior art that are not required in the subject invention include aluminum, carbon black, copper chloride, zinc chloride, high explosives, smokeless powder and the like.

The carbonaceous fuel component utilizable within the scope of this invention can include most hydrocarbons, for example, paraffinic, olefinic, naphthenic, aromatic, saturated or unsaturated hydrocarbons. In general, the carbonaceous fuel is a water immiscible emulsifiable fuel which is either liquid or liquefiable at a temperature up to about 200 degrees F, and preferably between 110 degrees F and about 160 degrees F. It is preferable that the emulsion contain from about 3 to about 7% by weight of the fuel and that the fuel include wax, emulsifier, and optionally, an oil. The water-in-oil emulsion should preferably contain at least about 2 weight percent wax, from about 0.5 to about 1.5 weight percent emulsifier, and from 0 to about 1 weight percent oil.

Examples of suitable waxes include waxes derived from petroleum such as petrolatum wax, microcrystalline wax and paraffin wax; mineral waxes such as ozocerite and montan wax; animal waxes such as spermacetic wax; insect waxes such as beeswax and Chinese wax, and mixtures thereof. Preferred waxes include waxes identified by the trade designations INDRA 1153 and INDRA 2119 sold by Industrial Raw Materials Corporation. Examples of suitable oils include the various petroleum oils, vegetable oils and dinitrotoluene, and a highly refined mineral oil sold by Atlantic Refining Company under the trade designation ATREOL. The subject emulsions can optionally contain up to about 5% by weight of another fuel such as sulfur.

The carbonaceous fuel component will also include the emulsifier which is used within the scope of the invention. The emulsifier is a water-in-oil emulsifier such as those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters such as polyethylene sorbitol beeswax derivative materials and polyoxyethylene(4)lauryl ether, polyoxyethylene(2)ether, polyoxyethylene(2)stearyl ether, polyoxyalkylene oleyl laurate, oleyl acid phosphate, substituted oxazolines and phosphate esters and mixtures thereof, and the like.

The water-in-oil emulsions of the subject invention can contain from about 14% to about 20% by weight water.

The emulsions of the subject invention will generally comprise three different inorganic oxidizer salts. While the principal preferred inorganic oxidizer salt is ammonium nitrate, the emulsions will further comprise lesser amounts of another inorganic nitrate such as an alkali or alkaline earth metal nitrate, and also an inorganic perchlorate such as an alkali or alkaline earth metal perchlorate. The water-in-oil emulsions of the subject invention should contain from about 56% to about 63% by weight ammonium nitrate, from about 2% to about 12% and preferably about 10% by weight of another inorganic nitrate such as sodium nitrate, and from about 3% to about 12% and preferably from about 4% to about 8% by weight of a perchlorate such as ammonium perchlorate, sodium perchlorate, or potassium perchlorate.

In general, the water-in-oil emulsion explosive compositions of the subject invention are sensitive to a standard No. 8 blasting cap at ambient conditions or lower and have excellent storage stability. These emulsions have exhibited No. 8 cap sensitivity at 32 degrees F and after being stored for well over a year.

The improved emulsions of the subject invention are preferably made by premixing the water and the inorganic oxidizer salts in a first premix, and the carbonaceous fuel and emulsifier in a second premix. The two premixes are then heated, if necessary. The first premix is generally heated until the salts are completely dissolved (about 120 to 205 degrees F), and the second premix is heated until the carbonaceous fuel has liquefied (generally about 120 degrees F or more for the wax materials). The premixes are then blended together and emulsified. In the continuous manufacture of the emulsion compositions, it is preferable to prepare an aqueous solution containing the oxidizers in one tank and to prepare a mix of the organic fuel components, excluding the emulsifier, in another tank. Thereafter, the two liquid mixes and the emulsifier are pumped separately to a mixing device wherein they are emulsified. The resulting emulsion is then packaged through a Bursa filler or other conventional device into cartridges of desired diameters. According to a preferred embodiment of the invention, the emulsion explosive compositions thus formed are packaged in polyethylene bags or paper cartridges.

In general, the subject emulsions are made at a density ranging from about 0.80 to less than about 1.0 g/cc, and preferably from about 0.90 to about 0.95 g/cc, if they are not to be detonated within about 24 hours after manufacture. The density of the emulsion is controlled by regulating the amount of gas occluded within the carbonaceous fuel phase. The gas, preferably air, is occluded within the carbonaceous fuel by means of a mixing device such as that disclosed in U.S. Pat. No. 3,642,547. The air is added as the carbonaceous fuel passes through a mixing zone across which there is a pressure drop of at least about 5psi, and preferably about 25 psi. The density of the product can be changed almost instantaneously by changing the flow rate of the gas stream entering the system. At least about 2% wax by weight of the total composition is required in the carbonaceous fuel to facilitate the occlusion of sufficient air within the emulsion. The density of the emulsion as it leaves the mixer is referred to as the "dump density." If the dump density of the subject emulsions is greater than about 1.0 g/cc, they will not detonate with a No. 8 blasting cap after aging for more than about 24 hours. If, however, the emulsions are manufactured with a dump density ranging from about 0.80 to less than about 1.0 g/cc and are subsequently allowed to age to a density greater than about 1.0 g/cc, they will remain No. 8 cap sensitive.

The following examples are set forth in order to more fully describe the present invention. However, it is to be understood that the examples are for illustrative purposes only and are not to be construed as unduly limiting the scope of the invention.

EXAMPLE 1

The compositions set forth in Table 1 below were prepared by mixing a premix of water and the inorganic oxidizers at 146 degrees F, and a second premix of the carbonaceous fuel and the emulsifier at 130 degrees F. The first premix was then slowly added to the second premix with agitation to obtain the water-in-oil emulsions of the subject invention.

TABLE 1

| INGREDIENTS | COMPOSITIONS (WT %) 1 | 2 | 3 | 4 |
|---|---|---|---|---|
| Wax[1] | 4.5 | 4.5 | 4.5 | 5.4 |
| Oil[2] | 0.5 | 0.5 | 0.5 | 0.6 |
| Emulsifier[3] | 1.0 | 1.0 | 1.0 | 1.2 |
| Water | 20.0 | 17.0 | 17.0 | 16.8 |
| Ammonium Nitrate | 56.0 | 63.0 | 63.0 | 62.2 |
| Sodium Nitrate | 10.0 | 10.0 | 10.0 | 9.9 |
| Ammonium Perchlorate | 8.0 | 4.0 | | 3.9 |
| Potassium Perchlorate | | | 4.0 | |
| PROPERTIES | | | | |
| Dump Density (g/cc) | 0.92 | 0.94 | 0.92 | 0.89 |
| Cartridge Diameter (in.) | 1.25 | 1.25 | 1.25 | 1.25 |
| Aging Period During Which Emulsion Remained No. 8 Cap Sensitive At Ambient Conditions (mos.) | 2 | 17 | 14 | 4-½ |

[1]paraffin wax sold under the trade designation INDRA 1153 by Industrial Raw Materials Corporation
[2]ATREOL 34 mineral oil sold by Atlantic Refining Company
[3]ATMOS 300, a glyceride water-in-oil emulsifier sold by ICI, U.S.

All of the compositions set forth in Table 1 were packaged in cartridges having a diameter of 1.25 inches, sealed and stored. The cartridges were detonated with a No. 8 cap at 1, 2 and 4 weeks after manufacture, and every 4 weeks thereafter. Sensitivity tests were conducted at both the ambient temperature and at 90 degrees F.

Composition 1 detonated with a No. 8 cap 4 weeks after manufacture, at which time its density was 0.97 g/cc. Composition 1 continued to detonate with a No. 8 cap 8 weeks after manufacture at 90 degrees F.

Composition 2 detonated without failure with a No. 8 blasting cap after 64 weeks of storage, at which time its density was 1.07 g/cc. Composition 2 continued to detonate with a No. 8 cap after 76 weeks at 90 degrees F, and a density of 1.04 g/cc.

Composition 3 remained No. 8 cap sensitive after 60 weeks at ambient temperature, at which its density was 0.99 g/cc. Composition 3 detonated with a No. 8 cap after 52 weeks at a temperature of 90 degrees F.

Composition 4 detonated with a No. 8 cap at both ambient conditions and 90 degrees F after 20 weeks of storage. The densities of the two samples were 1.13 g/cc and 1.06 g/cc, respectively. These results indicate the improved water-in-oil emulsions of the subject invention remain sensitive to a No. 8 blasting cap after prolonged storage, even though they contain no sensitizer other than occluded air.

EXAMPLE 2

The compositions set forth in Table 2 below were prepared by the same method that was utilized to prepare Compositions 1–4 in Table 1.

TABLE 2

| | COMPOSITIONS (Wt %) | |
|---|---|---|
| INGREDIENTS | 5 | 6 |
| Wax[1] | 3.0 | 2.5 |
| Oil[2] | | 0.5 |
| Emulsifier[3] | 1.0 | 1.0 |
| Water | 20.0 | 20 |
| Ammonium Nitrate | 59.0 | 61.0 |
| Sodium Nitrate | 2.0 | 2.0 |
| Ammonium Perchlorate | 10.0 | 10.0 |
| Sulfur | 5.0 | 3.0 |
| PROPERTIES | | |
| Dump Density (g/cc) | 1.12 | 1.13 |
| Cartridge Diameter (in.) | 1.0 | 1.0 |
| Sensitivity | No. 6 | No. 6 |

[1]paraffin wax sold under the trade designation INDRA 2119 by Industrial Raw Materials Corporation
[2]ATREOL 34 mineral oil sold by Atlantic Refining Company
[3]ATMOS 300, a glyceride water-in-oil emulsifier sold by ICI, U.S.

The compositions shown in Table 2 differ from those in Table 1 in that they contain additional minor amounts of sulfur. Furthermore, the compositions of Table 2 were tested for sensitivity within 24 hours of manufacture and it was not necessary, therefore, for their dump densities be less than 1.0 g/cc as is the case for emulsions that are not used within 24 hours. Compositions 6 and 7 were packaged in diameters of 1". Both compositions were sensitive to a No. 6 blasting cap even though they contained no sensitizer other than occluded air.

The above examples illustrate that extremely sensitive explosives in the form of water-in-oil emulsions containing no sensitizer other than occluded air can be made in accordance with the subject invention. The explosive compositions disclosed herein are at least sensitive to conventional No. 8 blasting caps and are suitable for detonation in small diameters of 1.25 inches or less. Furthermore, the explosive compositions taught herein are suitable for use as primers for other less sensitive explosives.

Thus, I have discovered that water-in-oil emulsion explosive compositions can be made No. 8 cap sensitive without the use of any sensitizer other than occluded air. The subject water-in-oil emulsions are sensitized without the use of conventional high explosives, detonation catalysts, or other sensitizers, but yet are able to achieve cap sensitivity at low temperatures and to retain that sensitivity for prolonged periods. Furthermore, they will not produce headaches; they possess water resistance as an intrinsic property of their physical forms; they are safe against initiation by fire, rifle bullet, impact, friction or static electricity; they lend themselves to continuous processing and can be extruded during manufacture; and they are noncorrosive, that is, they are not severely acidic or basic.

While this invention has been described in relation to its preferred embodiments, it is to be understood that various modifications thereof will be apparent to those of ordinary skill in the art upon reading this specification and it is intended to cover all such modifications as fall within the scope of the appended claims.

I claim:

1. A cap sensitive emulsion explosive composition having a continuous carbonaceous fuel phase and a discontinuous water phase containing dissolved inorganic nitrates and perchlorate, said composition consisting essentially of:

(a) from about 3% to about 7% by weight of a carbonaceous fuel comprising at least about 2 weight percent wax, from about 0.5 to about 1.5 weight percent of an emulsifier, and from 0 to about 1.0 weight percent oil;

(b) from about 14% to about 20% by weight water;

(c) from about 56% to about 63% by weight ammonium nitrate;

(d) from about 2% to about 12% by weight of another inorganic nitrate;

(e) from about 3% to about 12% by weight of an inorganic perchlorate; and (f) a minor effective amount of occluded air to reduce the density of said composition to a level ranging from about 0.80 to less than about 1.0 g/cc at the time of manufacture.

2. The explosive composition of claim 1 wherein the inorganic nitrate of part (d) is selected from the group consisting of the alkali and alkaline earth metal nitrates.

3. The explosive composition of claim 2 wherein the other inorganic nitrate is sodium nitrate present in about 10% by weight of the total emulsion.

4. The explosive composition of claim 1 wherein the inorganic perchlorate is selected from the group consisting of the alkali and alkaline earth metal perchlorates.

5. The explosive composition of claim 4 wherein the inorganic perchlorate is selected from the group consisting of ammonium perchlorate, sodium perchlorate and potassium perchlorate.

6. The explosive composition of claim 1 wherein the amount of inorganic perchlorate ranges from about 4% to about 8% by weight of the total emulsion.

7. The explosive composition of claim 1 wherein the carbonaceous fuel comprises water immiscible emulsifiable material selected from the group consisting of petrolatum; microcrystalline, paraffin, mineral, animal and insect waxes; petroleum oils, vegetables oils, dinitrotoluene, and mixtures thereof.

8. The explosive composition of claim 1 wherein the emuslifier is selected from the group consisting of those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate; and mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)stearyl ether, polyoxyalkylene oleyl laurate, oleyl acid phosphate, substituted oxazolines and phosphate esters, and mixtures thereof.

9. The explosive composition of claim 1 wherein the density at the time of manufacture ranges from about 0.90 to about 0.95 g/cc.

10. The explosive composition of claim 1 additionally including up to about 5% sulfur, by weight of the total emulsion.

11. An emulsion explosive composition detonable at ambient conditions by a standard No. 8 blasting cap in a cartridge diameter of 1.25 inches and containing a continuous carbonaceous fuel phase and a discontinuous water phase having inorganic nitrates and perchlorate dissolved therein, said composition consisting essentially of:

(a) from about 3% by weight of a carbonaceous fuel comprising at least 2 weight percent wax, from about 0.5 to about 1.5 weight percent of an emulsifier, and from 0 to about 1.0 weight percent oil;
(b) from about 14% to about 20% by weight water;
(c) from about 56% to about 63% by weight ammonium nitrate;
(d) from about 2% to about 12% by weight of another inorganic nitrate;
(e) from about 3% to about 12% weight of an inorganic perchlorate; and
(f) a minor effective amount of occluded air to reduce the density of said composition to a level ranging from about 0.80 to less than about 1.0 q/cc at the time of manufacture.

12. The explosive composition of claim 11 wherein the inorganic nitrate of pair (d) is selected from the group consisting of the alkali and alkaline earth metal nitrates.

13. The explosive composition of claim 12 wherein the other inorganic nitrate is sodium nitrate present in about 10% by weight of the total emulsion.

14. The explosive composition of claim 11 wherein the inorganic perchlorate is selected from the group consisting of the alkali and alkaline earth metal perchlorates.

15. The explosive composition of claim 14 wherein the inorganic perchlorate is selected from the group consisting of ammonium perchlorate, sodium perchlorate and potassium perchlorate.

16. The explosive composition of claim 12 wherein the amount of inorganic perchlorate ranges from about 4% to about 8% by weight of the total emulsion.

17. The explosive composition of claim 11 wherein the carbonaceous fuel comprises water immisable emulsifiable material selected from the group consisting of petrolatum; microcrystalline, paraffin, mineral, animal and insect waxes; petroleum oils, vegetable oils, dinitrotoluene, and mixtures thereof.

18. The explosive composition of claim 11 wherein the emulsifier is selected from the group consisting of those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate; and mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)stearyl ether, polyoxyalkylene oleyl laurate, oleyl acid phosphate, substituted oxazolines and phosphate esters, and mixtures thereof.

19. The explosive composition of claim 11 wherein the density at the time of manufacture ranges from about 0.90 g/cc to about 0.95 g/cc.

20. The explosive composition of claim 1 additionally including up to about 5% sulfur, by weight of the total emulsion.

21. In a process for making an emulsion explosive composition having a continuous carbonaceous fuel phase and a discontinuous water phase that is detonable at ambient conditions by a standard No. 8 blasting cap in a cartridge diameter of 1.25 inches, said composition consisting essentially of from about 3% to about 7% by weight of a carbonaceous fuel, from about 14% to about 20% by weight water, from about 2% to about 12% by weight of an inorganic nitrate other than ammonium nitrate, from about 56% to about 63% by weight ammonium nitrate, from about 3% to about 12% by weight of an inorganic perchlorate, and occluded air, the improvement comprising occluding sufficient air within the composition so that its density at the time of manufacture ranges from about 0.80 to less than about 1.0 g/cc.

22. The product made according to the process of claim 21.

23. The process of claim 21 wherein the density at the time of manufacture ranges from about 0.90 g/cc to about 0.95 g/cc.

24. The product made according to the process of claim 23.

25. The process of claim 21 including the further step of allowing the composition to age for more than 24 hours after removal from the emulsifier.

26. The product made according to the process of claim 25.

27. The process of claim 25 wherein the density of the explosive composition increases to a level greater than 1.0 g/cc during aging.

28. The product made according to the process of claim 27.

29. A process for making an emulsion explosion composition having a continuous carbonaceous fuel phase and a discontinuous water phase that is detonable by a standard No. 8 blasting cap in a cartridge diameter of 1.25 inches comprising:

(a) combining from about 14% to about 20% water, from about 2% to about 12% of an inorganic nitrate other than ammonium nitrate, from about 56% to about 63% ammonium nitrate, and from about 3% to about 12% of an inorganic perchlorate in a first premix, by weight of the total composition;
(b) combining at least about 2% wax, from about 0.5% to about 1.5% of an emulsifier, and from 0 to about 1.0% oil, by weight of the total composition, in a second premix;
(c) blending the two premixes together in a mixer; and
(d) occluding sufficient air within the composition thus formed so as to achieve a density ranging from about 0.80 to less than about 1.0 g/cc.

30. The product made according to the process of claim 29.

31. The process of claim 29 wherein the two premixes are separately heated prior to emulsification.

32. The product made according to the process of claim 31.

33. The process of claim 29 wherein the first premix is heated until the salts are completely dissolved.

34. The process of claim 33 wherein the first premix is heated to a temperature ranging from about 120 to about 205 degrees F.

35. The process of claim 29 wherein the second premix is heated until the carbonaceous fuel has liquefied.

36. The process of claim 35 wherein the second premix is heated to a temperature greater than about 120 degrees F.

37. The process of claim 29 wherein the density at the time of manufacture ranges from about 0.90 g/cc to about 0.95 g/cc.

38. The product made according to the process of claim 37.

39. The process of claim 29 including the additional step of allowing the composition to age for a period of more than 24 hours between manufacture and use.

40. The product made according to the process of claim 39.

41. The process of claim 39 wherein the density of the explosive composition increases to a level greater than about 1.0 glcc.

42. The product made according to the process of claim 41.

* * * * *

UNITED STATES PATENT AND TRADEMARK OFFICE

CERTIFICATE OF CORRECTION

PATENT NO. : 4,149,916

DATED : April 17, 1979

INVENTOR(S) : Charles G. Wade

It is certified that error appears in the above-identified patent and that said Letters Patent are hereby corrected as shown below:

Column 1, line 33, chance "senstive" to --sensitive--.

Column 6, line 49, change "emuslifier to --emulsifier--.

Column 7, line 8, change "3% by" to --3% to about 7% by--;
line 17, change "12% weight" to --12% by weight--;
line 21, change "q/cc" to --g/cc--;
line 24, change "pair" to --part--.

Column 10, line 8, change "glcc" to --g/cc--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*